US006447021B1

(12) United States Patent
Haynes

(10) Patent No.: US 6,447,021 B1
(45) Date of Patent: Sep. 10, 2002

(54) LOCKING TELESCOPING JOINT FOR USE IN A CONDUIT CONNECTED TO A WELLHEAD

(76) Inventor: Michael Jonathon Haynes, Box 12, Site 7, R.R. #3, Innisfail, Alberta (CA), T4G 1T8

( * ) Notice: Subject to any disclaimer, the term of this patent is extended or adjusted under 35 U.S.C. 154(b) by 0 days.

(21) Appl. No.: 09/448,645

(22) Filed: Nov. 24, 1999

(51) Int. Cl.[7] ..... E21B 23/00

(52) U.S. Cl. ..... 285/302; 166/217; 166/382; 285/322

(58) Field of Search ..... 285/303, 322; 166/382, 217, 73, 240

(56) References Cited

U.S. PATENT DOCUMENTS

| | | | | | |
|---|---|---|---|---|---|
| 219,098 | A | * | 9/1879 | Jewell | 285/303 |
| 653,384 | A | * | 7/1900 | Grove | 285/303 |
| 2,693,974 | A | * | 11/1954 | Taylor | 285/303 |
| 2,748,261 | A | * | 5/1956 | Wolar | 285/303 |
| 2,919,900 | A | * | 1/1960 | Segelhorst | 285/303 |
| 3,098,667 | A | * | 7/1963 | Greenwood | 285/303 |
| 3,354,950 | A | * | 11/1967 | Hyde | 285/303 |
| 3,366,406 | A | * | 1/1968 | Morris | 285/303 |
| 4,076,084 | A | * | 2/1978 | Tighe | 285/303 |
| 4,256,179 | A | * | 3/1981 | Shillander | 285/303 |
| 4,391,326 | A | | 7/1983 | Greenlee | |
| 4,513,822 | A | | 4/1985 | Gilbert | |
| 4,526,241 | A | * | 7/1985 | Anders | 285/303 |
| 4,681,166 | A | | 7/1987 | Cuiper | |
| 4,722,390 | A | | 2/1988 | Smith, Jr. | |
| 5,332,266 | A | * | 7/1994 | Canale | 285/303 |

* cited by examiner

*Primary Examiner*—Eric K. Nicholson
(74) *Attorney, Agent, or Firm*—Nelson Mullins Riley & Scarborough, LLP

(57) ABSTRACT

A locking telescoping joint is for use in a conduit connected to a wellhead, which permits the conduit to be axially displaced to a new position in the well bore without disconnecting the conduit from the wellhead, and secured in the new position. The locking telescoping joint includes two telescopically interconnected tubular sections which are relatively movable between a fully retracted and a fully extended position and can be locked in a desired position. In contrast with telescoping joints without the locking function which is useful to axially display downhole tools attached to the bottom end of the conduit. The locking telescoping joint enables the use of the telescoping joint to be extended into new applications, such as placing and maintaining a tubing string in tension or compression. The use of the locking telescoping joint reduces the time and cost of many well completion and maintenance operations and thereby reduces the cost of producing hydrocarbons.

19 Claims, 6 Drawing Sheets

LOCKING TELESCOPING JOINT FOR USE IN A CONDUIT CONNECTED TO A WELLHEAD

TECHNICAL FIELD

The present invention relates to the handling of a tubing string in a well bore and, in particular, to a locking telescoping joint for use in a conduit connected to a wellhead which permits the conduit to be axially displaced to a new position in the well bore without disconnecting the conduit from the wellhead and secured in new positions using the locking telescoping joint.

BACKGROUND OF THE INVENTION

Downhole operations and the handling of a tubing string in a completed well has always presented a certain challenge, especially when working in wells having a natural pressure.

In Applicant's U.S. Pat. No. 5,957,198 which issued Sep. 28, 1999 and is entitled TELESCOPING JOINT FOR USE IN A CONDUIT CONNECTED TO A WELLHEAD AND ZONE ISOLATING TOOL, the specification of which is incorporated herein by reference, a telescoping joint is described for use in a conduit connected to a wellhead. The telescoping joint is adapted to support downhole well tools and to permit the downhole well tools to be axially displaced in the well bore without disconnecting the conduit from the wellhead. The telescoping joint is freely extendable and retractable. Downhole anchors or packers are used to support the conduit in the well bore. Although the telescoping joint has proven extremely useful and has generated significant commercial interest, it is not ideally suited for all downhole tasks and applications due simply to its freely extendable and retractable features. In order to extend the use of the telescoping joint into yet a broader range of applications, further improvement of the telescoping joint, particularly to enable releasably locking the telescoping joint at a selected extension, is desired.

For example, production tubing strings are generally anchored at the bottom end to the cased well bore. The length of the production tubing string is usually between 1,500 and 5,000 m (5,000'–16,000'). Over time, a production tubing string will sag under its own weight because of the significant length. This is a disadvantage if a surface driven reciprocating pump is used for production because a sucker rod used to drive the pump may wear and bind in the sagging production tubing string. In order to overcome this problem, long production tubing strings are usually tensioned before production is started. The tensioning process involves unhooking the production tubing from the tubing hanger; pulling up the production tubing string to tension it to a desired extent; marking the production tubing string where it should be reconnected to the tubing hanger; preparing a pup joint having a length equal to a distance from the mark to a next joint in the tubing string; replacing the top joint with the pup joint and re-connecting the tubing hanger. This is a time consuming and expensive procedure that may require killing the well. It is therefore desirable to provide a tool for tensioning a tubing string without removing the wellhead from the well.

There are also times when it is desirable to load a tubing string in compression. For example, if a downhole submersible pump is used for production, equipment costs can be reduced by using a less expensive compression packer to anchor the production tubing above the submersible pump. In order to ensure that the packer does not slip, it must be constantly loaded with compressive force. It is therefore desirable to provide a telescoping joint that permits a production tubing to be locked in compression.

Latch assemblies and collet devices for interconnecting tubing members are well known in the art. Examples can be shown in U.S. Pat. No. 4,391,326 entitled STINGER ASSEMBLY FOR OIL WELL TOOL which issued to Dresser Industries, Inc. on Jul. 5, 1983; U.S. Pat. No. 4,513,822 entitled ANCHOR SEAL ASSEMBLY which issued to HUGHES TOOL COMPANY on Apr. 30, 1985; U.S. Pat. No. 4,681,166 entitled INTERNAL NONROTATING TIE-NECK CONNECTOR which issued to Hughes Tool Company on Jul. 21, 1987; and U.S. Pat. No. 4,722,390 entitled ADJUSTABLE COLLET which issued to Hughes Tool Company on Feb. 2, 1988.

These patents generally describe an annular latch carried by an inner conduit having collet arms that are radially flexible and adapted to engage a latch point on an outer conduit. A relative axial movement between the two conduits is permitted in one direction only to permit threads of the collet arms to ratchet into or out of engagement with the threads of the outer conduit while the relative axial movement in an opposite direction is generally inhibited by the threaded connection to support a work load unless another manipulation is performed. However, none of these patents suggest a latch assembly to releasably lock a telescoping joint in a relative axial extension. Furthermore, these patents do not show or suggest a latch assembly having a plurality of latch points disposed along a travel length of a telescoping joint.

SUMMARY OF THE INVENTION

It is an object of the invention to provide a telescoping joint for use in a conduit connected to a wellhead to permit the conduit to be axially displaced and locked in the displaced position in the well bore without disconnecting the conduit from the wellhead.

It is another object of the invention to provide a telescoping joint for use in a tubing string in a well bore, which includes a latch assembly for locking the telescoping joint at a predetermined axial extension.

It is a further object of the invention to provide an apparatus for use in a tubing string in a well bore to maintain tension or a compression on the tubing string.

It is yet a further object of the invention to provide a method of maintaining tension or compression on a tubing string in a well bore.

In accordance. with one aspect of the invention a locking telescoping joint is provided for use in a conduit connected to a wellhead to permit the conduit to be axially displaced in the well bore without disconnecting the conduit from the wellhead. The locking telescoping joint comprises first and second telescopingly interconnected tubular sections having opposite ends adapted for connection to the conduit. A latch assembly is provided for releasably locking the first and second tubular sections in at least one position between a fully retracted and a fully extended position.

Preferably, the latch mechanism comprises a first engaging member affixed to one of the tubular sections, and at least one second engaging member affixed to the other tubular section. The first engaging member is adapted to be releasably received in the second engaging member in order to lock the telescopic tubular sections in an axial position relative to each other. The latch mechanism may be any type of releasable engagement adapted to support the weight of a tubing string. For example, a J-latch, key, collet or slip type latch mechanism may be used.

According to a first embodiment of the invention, the latch assembly includes at least one pin radially extending from one of the tubular sections and a plurality of axially spaced-apart slots defined in the other of the tubular sections. The slots are preferably interconnected by an axial groove adapted to serve as a passage route for the pin.

According to another embodiment of the invention, one of the tubular sections includes a radially collapsible collet which can be manipulated between a collapsed condition for axial movement of the telescoping joint and an expanded condition for locking the telescoping joint at a predetermined extension, and the other of the tubular sections includes at least one cooperative latch point, the cooperative latch point being adapted to cooperate with the collapsible collet during the manipulation between the collapsed and expanded conditions.

More specifically, one embodiment of the collet type latch mechanism includes a traveling collet which is adapted to be collapsed by the at least one cooperative latch point when forcibly moved past the latch point in either axial direction, and a locking collet which is adapted to be manipulated between a collapsed condition for axial movement of the telescoping joint and an expanded condition for locking the telescoping joint at a predetermined extension.

In accordance with another aspect of the invention, the telescoping joint enables a method for maintaining tension or compression on a tubing string in a cased well bore. The method comprises the steps of: a) inserting a lift rod string into the tubing string which is attached at a top end to a wellhead and anchored at a bottom end to the cased well bore, the tubing string including a locking telescoping joint in the top end; b) latching the rod to a latch point of the telescoping joint; c) retracting or extending the telescoping joint to tension or compress the tubing string by manipulating the rod; d) and, locking the telescoping joint in the retracted or extended position using a latch assembly in the telescoping joint to maintain the tension or compression on the tubing string.

The telescoping joint with the latch assembly in accordance with the invention provides improved functionality compared with the telescoping joint described in Applicant's issued U.S. Pat. No. 5,957,198 and is adapted for use in each application described in that patent. Furthermore, the selective extension locking feature enables the use of the telescoping joint to be extended to new applications, such as the above-disclosed examples of tensioning or compressing the tubing string in a cased well bore, as well as many others. For example, the locking telescoping joint in accordance with the invention can be used to reposition or otherwise manipulate downhole tools. Such tools include any one of a zone isolation tool, a packer, a hanger, a plug, a subsurface safety valve, and a downhole tool having a slip, collet, threaded or keyed locking engagement that is releasable and resetable by remote manipulation from a surface surrounding the well. Consequently, the time and cost of well completion and well maintenance are reduced as is the cost of production of hydrocarbons in wells with a mobile oil/water interface or other condition that requires periodic downhole maintenance.

BRIEF DESCRIPTION OF THE DRAWINGS

The invention will now be explained by way of example only and with reference to the following drawings, in which.

DETAILED DESCRIPTION OF THE PREFERRED EMBODIMENT

The invention provides an apparatus and method for using the apparatus for performing downhole operations in well bores which require the axial displacement of downhole tools and/or the axial displacement of well tubing in the well bore. The invention also provides a practical means for maintaining tension or compression on a tubing string in the well bore.

Figure 1:
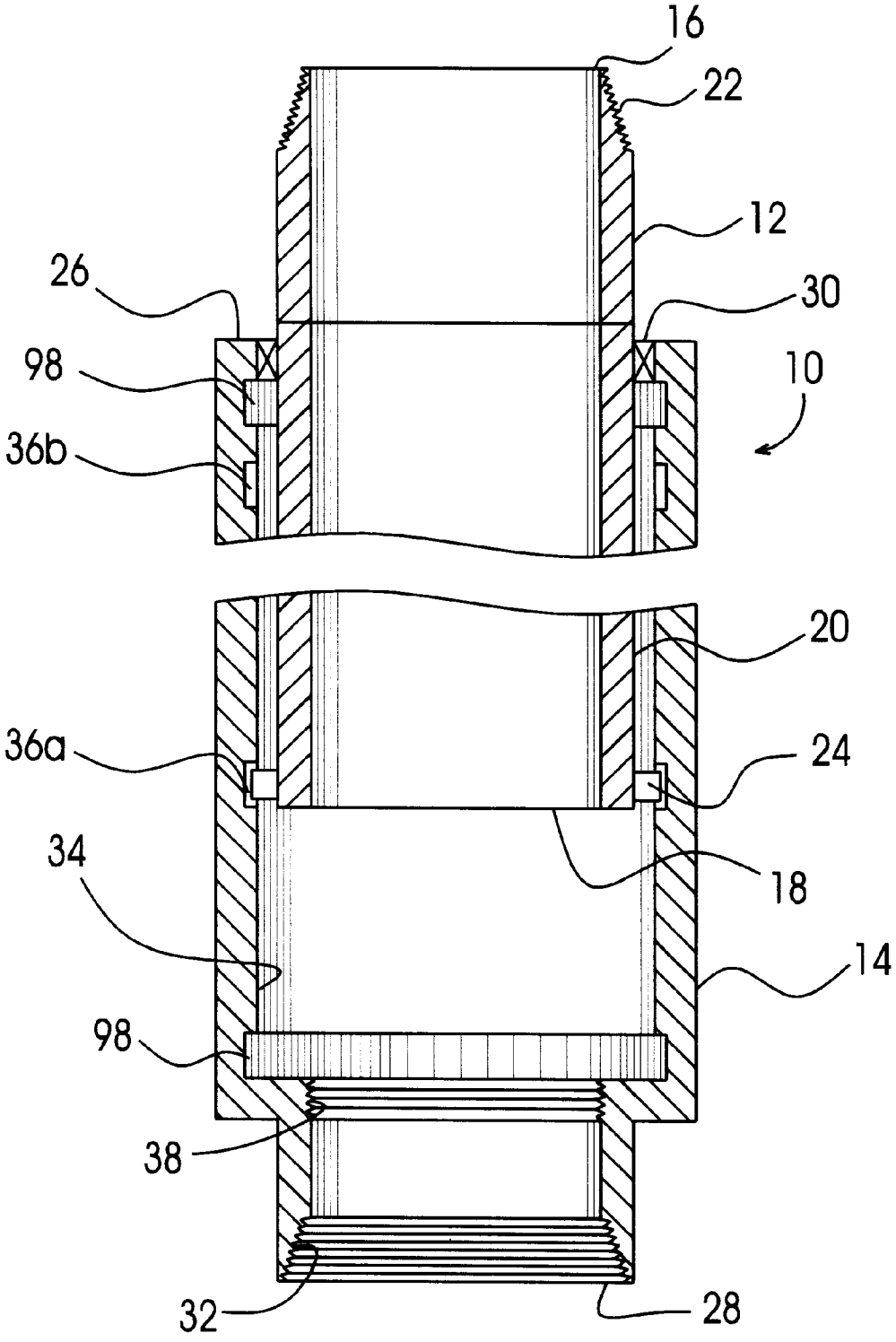
FIG. 1 is a cross-sectional view of a telescoping joint including a latch assembly for use in a conduit connected to a wellhead in accordance with one embodiment of the invention.

FIG. 1 shows a cross-sectional view of a locking telescoping joint with a latch assembly in accordance with the invention for use in a conduit such as a production tubing connected to a wellhead for permitting the conduit to be axially displaced in the well bore without disconnecting the conduit from the wellhead. The locking telescoping joint, generally indicated by reference numeral 10, includes a first tubular section 12 and a second tubular section 14 which has a larger diameter than the first tubular section.

The first tubular section 12 has a first end 16, a second end 18 and a polished outer surface 20 which extends between the first end 16 and the second end 18. The first end 16 is machined with a standard thread 22 which is compatible with standard tubing connectors. The second end 18 of the first tubular section 12 is provided with a radially projecting latch member that engages a complementary latch point on an inner surface of the second tubular section 14. The latch member and the latch point may have any configuration that permits selective engagement/disengagement and is adapted to support the weight of a tubing string, as will be described in detail below. In the example shown in FIG. 1, a J-latch type of latch assembly includes a pair of latch pins 24 that cooperate with a plurality of spaced-apart latch points to selectively lock the telescoping joint in one of a plurality of predetermined extensions. The latch pins 24 also prevent the first tubular section 12 from being completely withdrawn from the second tubular section 14 within which it reciprocates.

The second tubular section 14 includes a first end 26 and a second end 28. The first end 26 includes inwardly extending seals 30 which cooperate with the polished outer surface 20 of the first tubular section 12 to provide a fluid seal between the first and second sections. The fluid seals 30 are preferably high pressure fluid seals to ensure that high pressure fluids do not escape from the telescoping joint 10. The second end 28 of the second tubular section 14 is threaded with an internal thread 32 to enable the connection of a production tubing. As will be well understood, the first end 16 of the first tubular section 12 may have an internal thread and the second end 28 of the second tubular section 14 may have an external thread. It is preferable, however, that the opposite ends of the telescoping joint have compatible but opposite threads as is standard for any production tubing section. A plurality of cooperative latch points are provided on the internal surface 34 of the second tubular section for selectively engaging the latch members on the outer surface 20 of the first tubular section. Two pairs of circumferentially extending slots 36*a*, 36*b* serve as latch points that receive the latch pins 24. Axial grooves 68 (see FIGS. 2–5) are provided between the axially spaced-apart latch points 36*a*, 36*b* for providing a path of travel for the latch pins 24 to permit the first tubular section 21 to travel within the second tubular section 14.

The telescoping joint 10 optionally includes a latch point 38 for the connection of a lift rod (see FIG. 10) which may be used to displace the production tubing string and/or downhole well tools connected to the production tubing string. The latch point 38 may be, for example, an internal thread. While the latch point 38 is shown on an inner surface on the second end 28 of the second tubular section 14, it may likewise be provided on the second end 18 of the first tubular section if the telescoping joint 10 is oppositely oriented with respect to the wellhead. The orientation of the telescoping joint 10 is a matter of design choice and is only material with respect to the location of the latch point 38 which should be located on the tubular section of the telescoping joint 10 that is remote from the wellhead in order to practice the methods in accordance with the invention, which will be explained below in detail. As will be understood by persons skilled in the art, the lift rod may be latched in the tubing string below the telescoping joint.

Circumferential grooves 98 preferably located at opposite ends of the inner surface 34 of the second tubular section 14 permit the second tubular section 14 to be freely rotated with respect to the first tubular section 12 when the telescoping joint is at the limits of its relative travel. This permits the rotary manipulation of downhole components. As will be understood by those skilled in the art, the latch points 70, 72 (FIG. 4) may likewise be shaped to permit rotation within any arc up to and including 360°.

Figure 4:
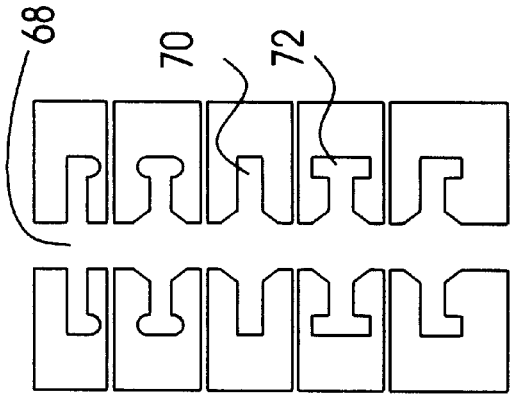
FIGS. 2–5 are schematic views of latch mechanisms in accordance with the first embodiment of the invention.
Figure 5:
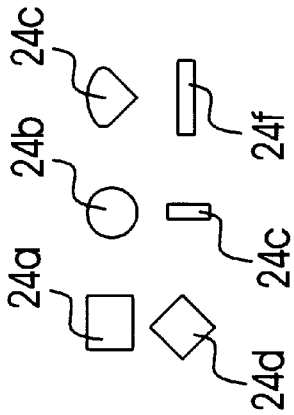
Figure 3:
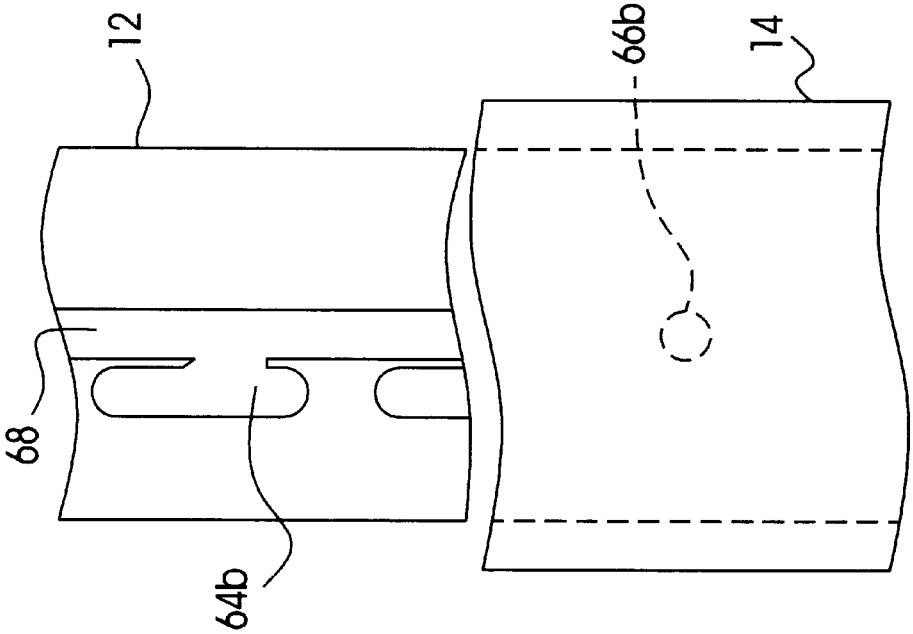
Figure 2:
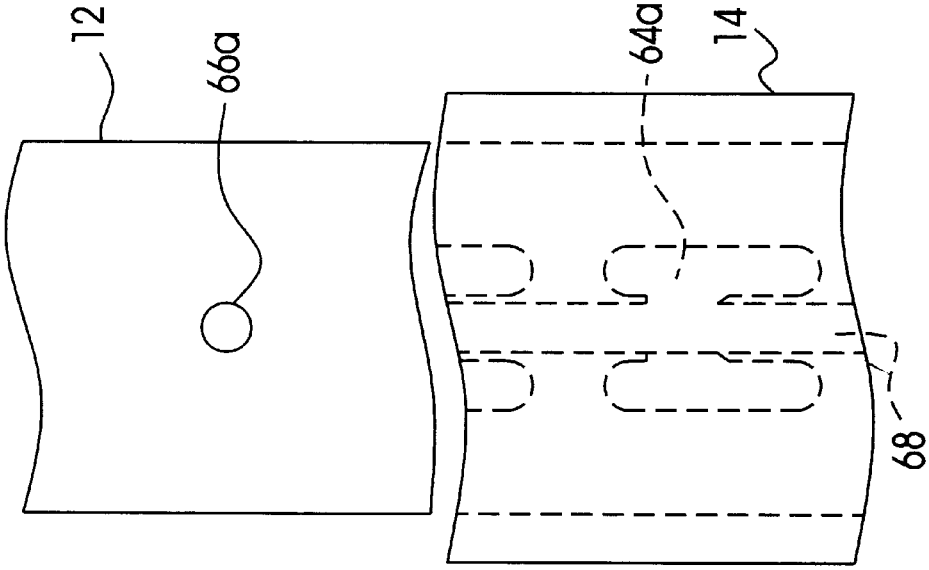

FIGS. 2 to 5 show variations and details of the J-latch type of latch assembly illustrated in FIG. 1. The slots 36*a*, 36*b* are machined in the inner surface of the second tubular section 14, indicated by reference numeral 64*a,b*. Accordingly, the latch pin is affixed to the outer surface of the first tubular section 12, indicated by reference numerals 66*a,b*. The latch points can be formed in many different shapes as seen in FIG. 4. Generally, the groove 68 has a length equal to the travel of the telescoping joint 10 for providing the travel path for the latch pin 24. A plurality of latch points 70 extend circumferentially from the axial groove 68 in one direction, or in opposite directions and are axially spaced apart from one another to enable the telescoping joint to be locked at any one of a plurality of predetermined axial extensions. Each of the latch points 70 may have a closed end. The closed end may include an axial recess 72. The latch pin 24 is either a gudgeon pin or lug and can have practically any shape 24*a*–24*f*, as shown in FIG. 5. The shape of the latch pin 24 is preferably compatible with the shape selected for the latch points 70, 72.

Figure 6:
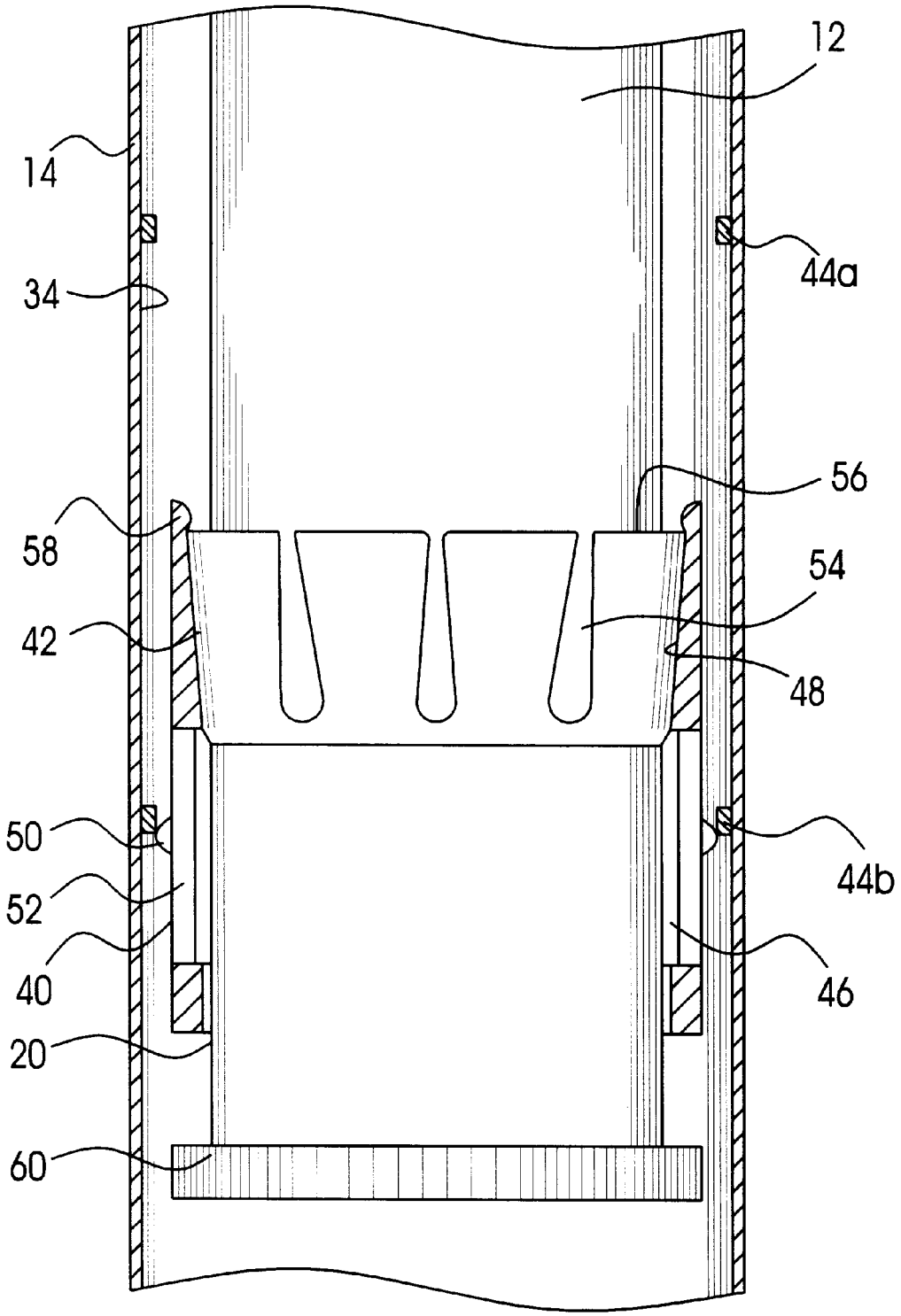
FIG. 6 is a partial cross-sectional view of a latch assembly in accordance with another embodiment of the invention.

FIG. 6 shows an alternate latch assembly for the telescoping joint 10 in accordance with another embodiment of the invention. Instead of the latch pins 24 and latch points 36*a*, 36*b* shown in FIGS. 2–4, the latch assembly shown in FIG. 6 is a collet type latch that includes a collapsible traveling collet 52 connected to a traveling sleeve 40 slidably mounted on the first tubular section 12, and a collapsible collet 42 mounted to the first tubular section 12 above the second end 18. A plurality of spaced-apart annular engagement ridges 44*a*, 44*b*, only two of which are shown, are affixed to the inner surface 34 of the second tubular section 14. The annular engagement ridges 44*a,b* cooperate with the collet latch to lock the telescoping joint at a plurality of predetermined axial extensions. A collet latch 48 affixed to a top end of the traveling sleeve 40 is used to lock the collet 42 in a closed condition which permits the collet 42 to be moved past an annular engagement ridge 44*a,b*.

The traveling latch 50 includes a plurality of slots (not shown) which permit it to collapse and slip past the annular engagement ridges 44*a,b* when it is forced against either side of the ridges with enough force. The force required to move the traveling latch 50 past an annular engagement ridge 44*a,b* should be considerably greater than the force required to collapse the collet 42 into the collet latch 48, or to force the collet 42 past a retainer lip 58 on an inner top surface of the collet latch 48 to free the collet 42 from the collet latch 48.

Figure 7:
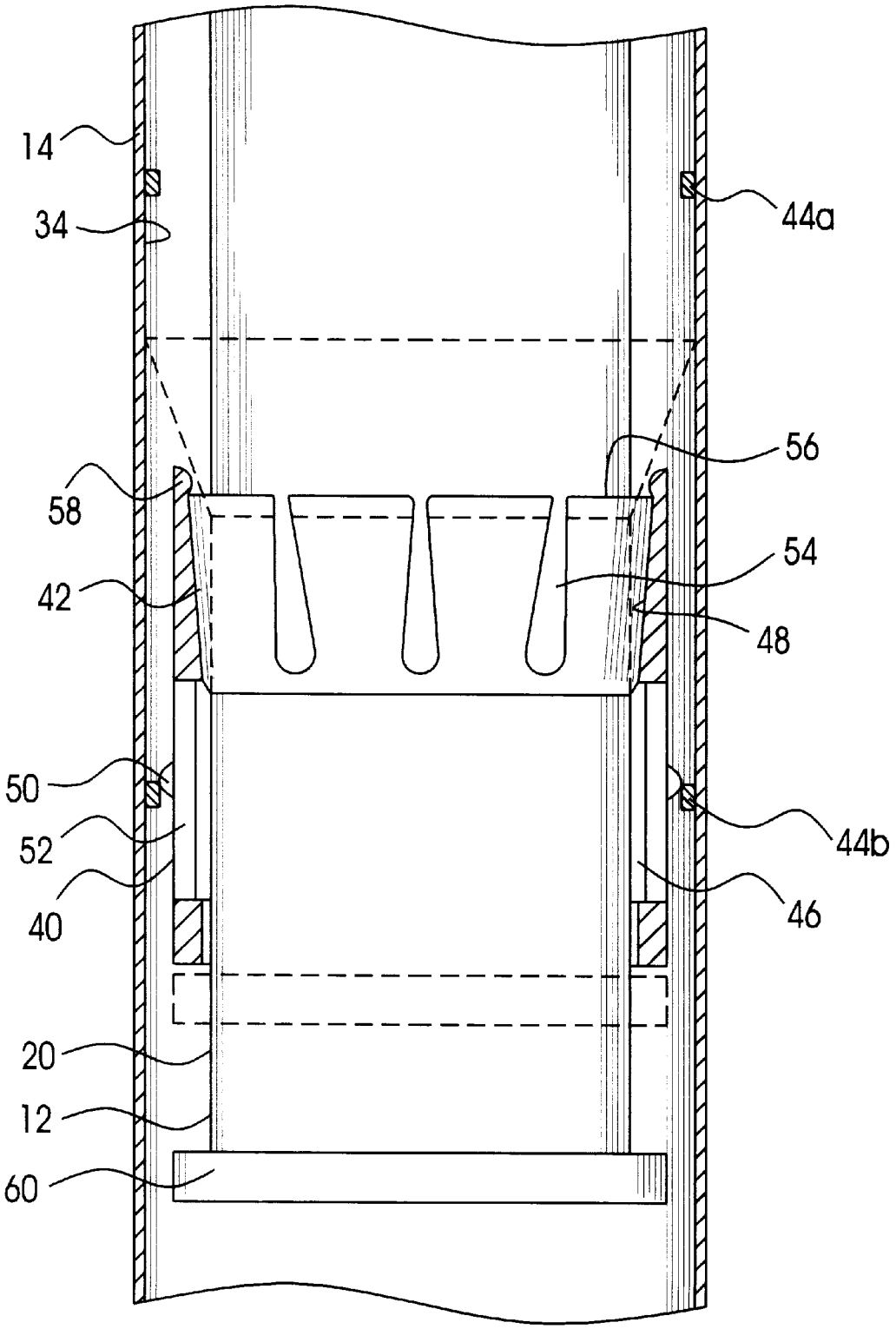
FIG. 7 is a partial cross-sectional view of the embodiment shown in FIG. 2 illustrating the latch assembly in a locking condition.

In operation, in order to shorten the telescoping joint, the first tubular section 12 with the sleeve 40 is able to be freely moved upwardly until the traveling latch 50 on the traveling sleeve 40 contacts an annular retainer ridge 44*b* if the collet 42 is locked in the collet latch 48. When the traveling latch 50 abuts the annular retainer ridge 44*a,b*, further movement of the first section 12 of the telescoping joint is inhibited until adequate pressure (e.g. 2,000–3,000 kg) is applied force the traveling latch 50 past the annular retainer ridge. When the upward force is applied (by the lift rod, not shown) the collet 42 is first forced out of the collet latch 48, as shown in dashed lines in FIG. 7, because the force required to move the collet 42 in and out of the collet latch is much less (e.g. 500–1,000 kg) than the force required to collapse the traveling latch, as described above. With the application of adequate force, the traveling latch is forced past the annular retainer ridge 44*a*. As shown in FIG. 7, the collet 42 will stop against the annular retainer ridge 44*a* unless it is forced back into the collet latch 48 by downward pressure on the first tubular section 12.

As is well understood in the art, the notches 54 in the collet 42 permit the collet to be collapsed into the collet latch 48. When the collet 42 is expanded, a top edge 56 of the collet 42 rests against an annular retainer ridge 44*a,b* and will support the weight of a tubing string and associated downhole equipment. In order to move the collet latch upwardly past the annular retainer ridge 44*a* shown in FIG. 7, downward pressure is first applied using the lift rod (not shown). The applied force is adequate to force the collet 42 into the collet latch 48, but inadequate to force the traveling latch 50 past the annular retainer ridge 44*b*. When the collet 42 is locked in the collet latch 48, the collet latch can be freely moved past the annular retainer ridge 44*a* and the series of steps described above is repeated until the traveling latch is forced past the annular retainer ridge 44*a*. This process may be repeated as many times as required, or until the limit of travel is reached.

In order to extend the length of the telescoping joint shown in FIGS. 6 and 7, the first tubular section 12 is simply forced downwardly using the lift rod (not shown) until the traveling latch is forced past the desired number of annular retainer ridges 44*a,b*, or the end of travel is reached. During the downward movement, the collet 42 remains locked in the collet latch 48.

As will be understood by those skilled in the art, the collet 42 shown in FIGS. 6 and 7 prevents extension of the telescoping joint. It therefore permits tubing strings to be placed in tension to prevent downhole tubing string sag when a reciprocal pump is driven from the surface using a sucker rod string. As is also well understood in the art, it is sometimes desirable to use inexpensive compression packers downhole, especially when a submersible production pump is used. However, even when a compression packer is used, the entire weight of the production tubing string is not permitted to rest on the packer. There is therefore still some tension on the tubing string at the wellhead and the collet shown in FIGS. 6 and 7 can be used to place an appropriate amount of weight on the downhole compression packer (not shown).

Figure 8:
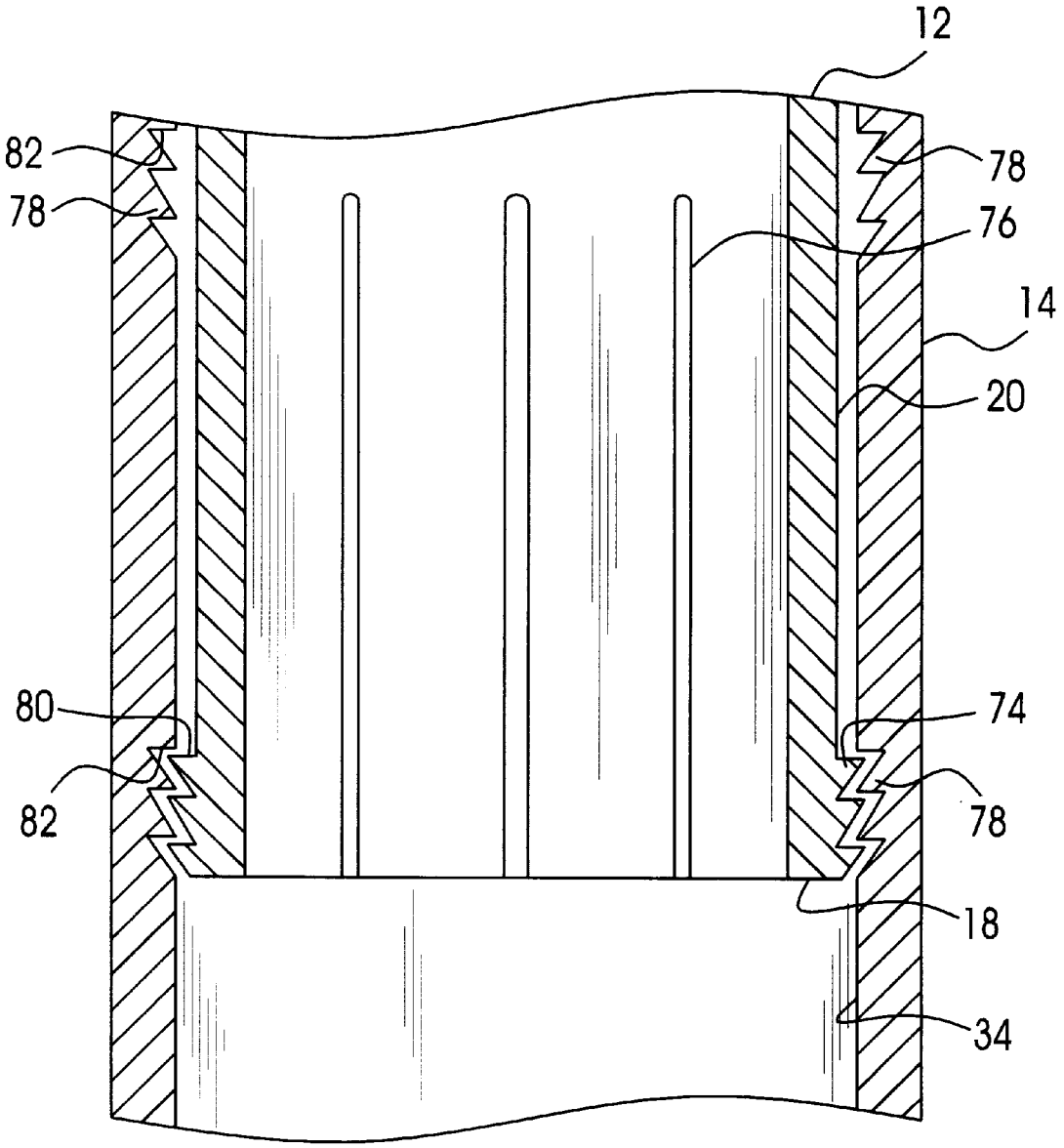
FIG. 8 is a partial cross-sectional view of another embodiment of a telescoping joint in accordance with the invention.

In another embodiment of the invention shown in FIG. 8, the latch assembly is a threaded collet. The threaded collet includes male threads 74 on the outer surface 20 of the first tubular section 12 at the second end 18. Elongated slots 76 extend axially from the second end 18 of the first tubular section 12 and are circumferentially spaced apart from one another to provide a radial flexibility for the male threads 74. A plurality of corresponding female threads 78, only two of which are shown in FIG. 8, are provided on the inner surface 34 of the second tubular section 14 and are axially spaced-apart to serve as latch points for engaging the male threads 76. Each of the respective male threads 74 and female threads 78 has an upper side 80, 82 that is substantially perpendicular to a longitudinal axis of the telescoping joint, so that the upper side 80 of the male threads 74 mesh with the upper side 82 of the female threads 78. Thus, the male threads 74 cannot ratchet upwardly past the female threads 78. On the other hand, the male threads can be forced down past the female threads 78 because the mating lower sides of the male and female threads are angularly oriented with respect to the axis of the telescoping joints.

In order to move the first tubular section 12 upwardly with respect to the second tubular section 14, the first tubular section 12 must be rotated to disengage the threaded connection. After disengagement, the collet is in a collapsed condition and the male threads 74 ride against the inner surface 34 of the second tubular section 14. The female threads 74 may alternatively have a square or rectangular cross-section. If the male threads 74 have complementary square or rectangular cross-sections, however, the second tubular section must be rotated through each latch point, regardless of the direction of travel. Triangular male threads configured as described above are therefore preferred.

The latch assembly shown in FIG. 8 is used to lock the telescoping joint 10 at a predetermined axial extension against a workload in one direction only. However, as described above even if compression packers are used, the full weight of the tubing string is not permitted to rest on the packer. The telescoping joint shown in FIG. 8 is therefore adapted for use in placing a tubing string in either tension or compression.

The latch assembly shown in FIG. 8 is used to lock the telescoping joint 10 at a predetermined extension to prevent the telescoping joint from further extension under a workload. If it is desired to use the telescoping joint locked at a predetermined extension against a compression workload, the triangular cross-section of the threads should be oppositely oriented. That is, the perpendicular side 80 of the male threads 74 should be reversed from the orientation shown in FIG. 8. The female threads 82 are, of course, likewise reversed in their axial orientation.

As noted above, the telescoping joint with the latch assembly in accordance with the invention is adapted to perform any function described in the Applicant's U.S. Pat. No. 5,957,198, plus many new applications enabled or facilitated by the ability to lock the telescoping joint at a plurality of predetermined axial extensions. Therefore, the telescoping joint with the latch assembly in accordance with the invention is adapted to be used in any downhole application in which downhole well tools are advantageously axially displaced in the well bore without disconnecting the tubing string from the wellhead, including, for example:

- displacement of a zone isolating tool in a production zone which produces both oil and water;
- barefoot completion of a well bore, in which the telescoping joint permits a hydraulic motor driven drill bit attached to the bottom end of the tubing string to complete the drilling of a well bore from the bottom of the casing to a target depth for the completed bore;
- for logging a producing formation, in which the production tubing string is retracted above the perforated zone so that a logging tool may be lowered to log the production zone; and
- any downhole manipulation of tubulars or tools connected to tubing strings.

Figure 9:
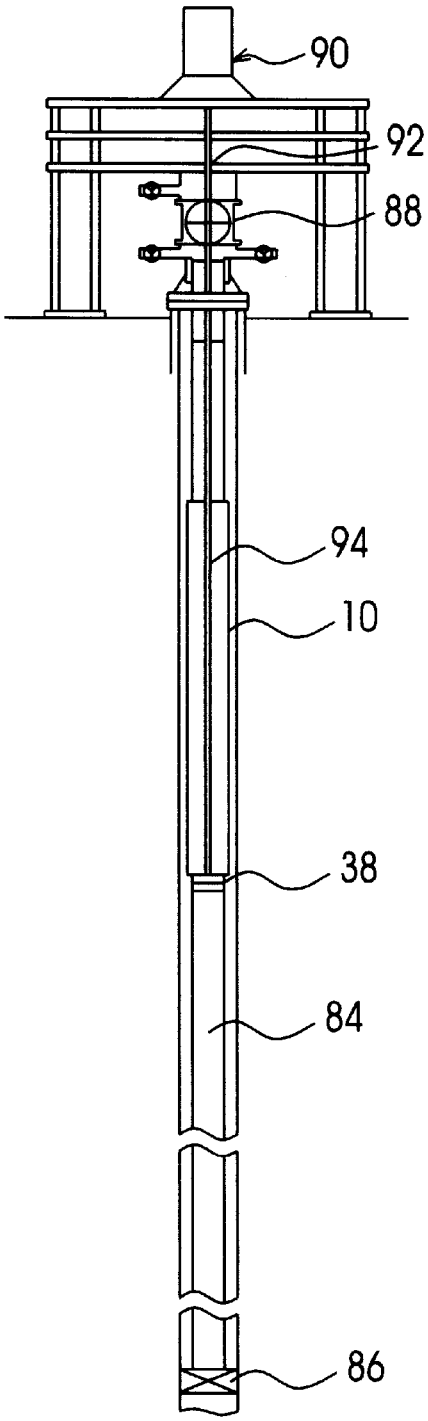
FIG. 9 is a schematic cross-sectional view of a well bore with a hoisting apparatus installed on the wellhead for tensioning a production tubing string using a telescoping joint in accordance with the invention.

FIG. 9 is a cross-sectional view of a telescoping joint 10 with a latch assembly in accordance with the invention being used to tension a production tubing string in a well bore. A long production tubing string tends to sag under its own weight. This is disadvantageous if a surface-driven reciprocating pump is used to recover hydrocarbons from the well, as explained above. Such tubing strings 84 are anchored at their bottom end by an anchor member 86, such as a packer connected to the bottom of the production tubing string 84. A top of the production tubing string 84 includes the telescoping joint 10 and is connected to a tubing hanger, not shown, in a wellhead 88. A lifting mechanism is temporarily installed on the wellhead 88 to enable the telescoping joint 10 to be retracted until the tubing string is under a desired tension to prevent undesirable sag as hydrocarbon is produced from the well.

Figure 10:
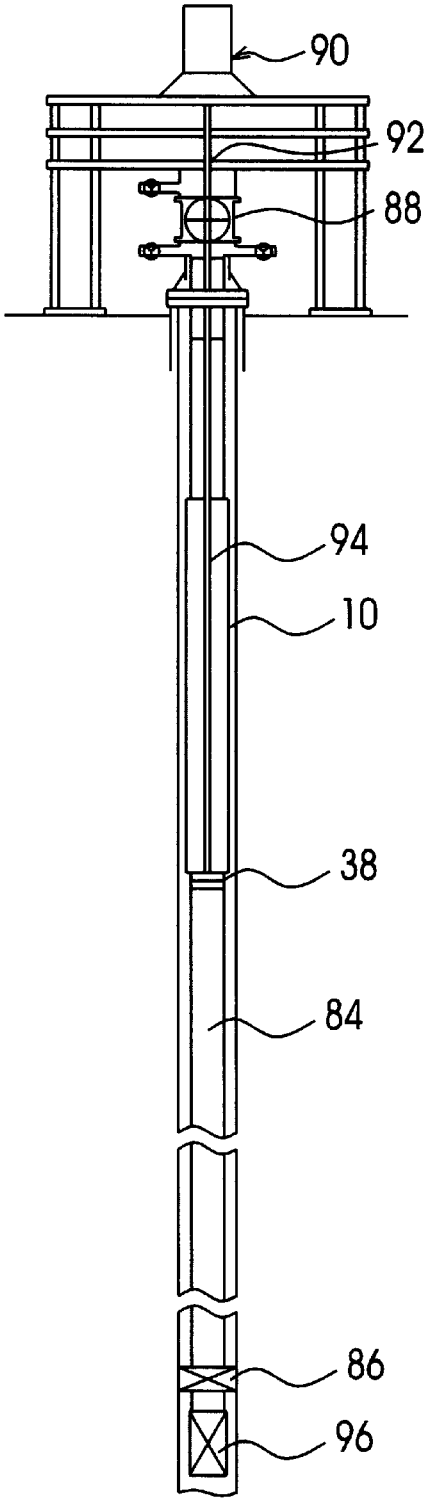
FIG. 10 is a schematic cross-sectional view of the well bore shown in FIG. 10 with a hoisting apparatus installed on the wellhead for placing a production tubing string in the well bore under compression using a telescoping joint in accordance with the invention.

The lift mechanism shown in FIG. 10 is preferably an apparatus for axially displacing a downhole tool or a tubing string in a well bore as described in applicant's co-pending U.S. patent application Ser. No. 08/992,235, the specification of which is incorporated herein by reference. The apparatus 90 is connected to a lift rod string 94 which runs through an annular seal 92 for containing well pressure and down through the wellhead 88 and the telescoping joint 10 to the latch point 38 (see FIG. 1). The lift rod string 94 connects to the latch point 38 to permit the production tubing string 84 to be raised or lowered as required when the production tubing string is suspended from the wellhead. When the bottom end of the production tubing string 84 is anchored. by anchor member 86 (a packer, for example) to the casing of the well bore, the retraction of the telescoping joint 10 using the lift rod string 94 will tension the production tubing string 84. When the production tubing string 84 is tensioned to a desired extent, the telescoping joint 10 is latched to an appropriate latch point, as described above.

The telescoping joint used for tensioning a production tubing string advantageously simplifies the conventional method in which a pup joint having a desired length has to be prepared to replace a top production tubing joint. As is well known, it is a time-consuming, expensive and potentially hazardous operation to determine a required length for the pup joint, and to install it. However, with a locking telescoping joint in accordance with the invention, the operation is quickly, easily and inexpensively done without removing the wellhead or danger of working over an open well bore. The locking telescoping joint 10 also permits the tubing string to be re-tensioned without removing the wellhead or killing the well if, over time, the tubing string loses its tension.

Another example of a new application for the telescoping joint is the use of the telescoping joint for setting a production tubing string under compression. This is desirable in circumstances when an economical compression packer is used to anchor a bottom of a production tubing string, as is common practice when hydrocarbons are produced using a submersible pump. As described above with reference to FIG. 10, the telescoping joint 10 is included in the top of the production tubing string 84, which is attached to a Tubing hanger (not shown) in the wellhead 88. The apparatus 90 is mounted to the wellhead and the lift rod string 94 is connected at the bottom end to the latch point 38 of the locking telescoping joint 10. The apparatus 90 is operated to set the compression packer 86 and to release a recommended portion of the weight of the tubing string onto the compression packer. When a required portion of the tubing string weight is supported by the compression packer, the locking telescoping joint 10 is locked at an appropriate latch point and the lift rod string is removed.

The locking telescoping joint 10 can also be used for other downhole operations which involve the selective repositioning or manipulation of tubing to set packers, plugs, subsurface safety valves or any other tool that includes a slip, collet, threaded or locking key or other locking or engagement device in the tubing string. Using the locking telescoping joint, such operations are quickly and easily accomplished without removing the wellhead or killing the well. Modifications to the preferred embodiments may occur to persons skilled in the art. For example, the telescoping joint 10 could designed to reciprocate under hydraulic pressure in wells having larger diameter casings. The hydraulically-powered cylinder could be equipped with hydraulic lines from the wellhead and be operated to reposition the downhole well tools without any lifting equipment on the surface.

Other modifications or variations may also become apparent to those skilled in the art. The scope of the invention is therefore intended to be limited solely by the scope of the appended claims.

I claim:

1. A locking telescoping joint for use in a conduit connected to a wellhead, comprising:

first and second telescopingly interconnected tubular sections having opposite ends adapted for connection to the conduit, the telescopically interconnected tubular sections being movable relative to each other from a fully retracted to a fully extended position, the second tubular section being freely rotatable with respect to the first tubular section in at least one position to permit rotary manipulation of downhole components; and a latch assembly for releasably locking the first and second tubular sections at a plurality of latch points disposed along a travel length of the telescoping joint between the fully retracted and the fully extended positions, and the latch assembly being adapted to prevent the second tubular section from being completely withdrawn from the first tubular section within which it reciprocates.

2. A locking telescoping joint as claimed in claim 1 wherein the latch assembly for releasably locking comprises:

a first engaging member amounted to one of the tubular sections, and a second engaging member mounted to the other tubular section, the first and second engaging members cooperating to lock the first and second telescopically interconnected tubular sections in the at least one position.

3. A locking telescoping joint as claimed in claim 2 wherein the means for releasably locking is adapted to permit the first and second engaging members to be moved past each other in a first axial direction, and to engage each other against a relative axial movement in the opposite direction unless a release manipulation is performed.

4. A locking telescoping joint as claimed in claim 3 wherein the first engaging member is a male engaging member and the second engaging member is a female engaging member.

5. A locking telescoping joint as claimed in claim 1 wherein the means for releasably locking comprises a collet mechanism which is mounted to one of the tubular sections and includes a locking collet that can be manipulated between a collapsed condition for axial movement of the telescoping joint and an expanded condition for locking the telescoping joint at a predetermined extension, at least one annular engagement ridge mounted to the other of the tubular sections, the annular engagement ridge being adapted to be engaged by the locking collet.

6. A locking telescoping joint as claimed in claim 5 wherein the collet mechanism includes a traveling collet which is adapted to be collapsed by the at least one cooperative retainer ridge when forcibly moved past the retainer ridge in either axial direction, and the locking collet which is adapted to be manipulated between a collapsed condition for axial movement of the telescoping joint and an expanded condition for locking the telescoping joint at a predetermined extension.

7. A locking telescoping joint as claimed in claim 6 wherein the locking collet is adapted to be manipulated into or out of the collapsed condition when the traveling collet abuts one of the retainer ridges.

8. A locking telescoping joint as claimed in claim 7 wherein manipulating force required to collapse the traveling collet is greater than a manipulating force required to collapse the locking collet.

9. A locking telescoping joint as claimed in claim 8 wherein the at least one annular engagement ridge is an annular ridge projecting from an inner wall of the other of the tubular sections, the opposite sides of the annular ridge being flat and substantially perpendicular to the inner wall.

10. A locking telescoping joint as claimed in claim 9 wherein the traveling collet is connected to a sleeve mounted to one of the tubular sections, an end of the sleeve adjacent the locking collet including a collet latch for receiving and retaining the locking collet when the locking collet is collapsed by forcing the traveling collet against the at least one retainer ridge to move the sleeve and the collet latch over the locking collet.

11. A locking telescoping joint as claimed in claim 10 wherein the tapered end of the axial passage of the sleeve includes a retainer ridge with a smooth surface adapted to releasably retain the locking collet therein.

12. A locking telescoping joint as claimed in claim 11 wherein travel of the sleeve is limited in one direction by the locking collet and in the opposite direction by a stop member.

13. A locking telescoping joint as claimed in claim 5 wherein the latch assembly comprises threads provided in a plurality of collet arms which are integrally formed with an inner one of the tubular sections, and axially spaced-apart complementary threads on the outer one of the tubular sections.

14. A locking telescoping joint as claimed in claim 13 wherein the threads on the collet arms of the inner one of the tubular sections have a substantially triangular cross-section, one side of each thread being substantially perpendicular to a longitudinal axis of the telescoping joint, and the threads on the outer one of the tubular sections have a complementary triangular cross-section so that the threads on the collet arms of the inner one of the tubular sections cannot ratchet past the threads on the outer one of the tubular sections in a first axial direction when the respective threads are engaged.

15. A locking telescoping joint as claimed in claim 2 wherein the first engaging member is a pin radially extending from one of the tubular sections and the second engaging member is a plurality of circumferentially oriented slots interconnected by an axial groove formed in the other of the tubular members.

16. A locking telescoping joint as claimed in claim 15 wherein the axial groove serves as a passage for the pin, and the plurality of circumferentially oriented slots are axially spaced-apart one from another for selectively securing the telescoping joint at a plurality of predetermined axial extensions.

17. A locking telescoping joint as claimed in claim 16 wherein each of the slots has a closed end.

18. A locking telescoping joint as claimed in claim 17 wherein the closed end of the respective slots includes an axially extending recess.

19. A locking telescoping joint as claimed in claim 1 further comprising a latch point for connection of a lift rod used to displace the production tubing string and manipulate the telescoping joint.

* * * * *